US006672121B2

(12) United States Patent
Carsley et al.

(10) Patent No.: US 6,672,121 B2
(45) Date of Patent: Jan. 6, 2004

(54) FLAT PINCH HEMMING OF ALUMINUM PANELS

(75) Inventors: John E. Carsley, Clinton Township, MI (US); Chongmin Kim, Davisburg, MI (US); John Robert Bradley, Clarkston, MI (US); George K. Nurminen, Troy, MI (US)

(73) Assignee: General Motors Corporation, Detroit, MI (US)

( * ) Notice: Subject to any disclaimer, the term of this patent is extended or adjusted under 35 U.S.C. 154(b) by 74 days.

(21) Appl. No.: 10/122,715

(22) Filed: Apr. 15, 2002

(65) Prior Publication Data

US 2003/0192362 A1 Oct. 16, 2003

(51) Int. Cl.[7] ..... B21D 26/02; B21D 5/16; B21D 39/02

(52) U.S. Cl. ..... 72/57; 72/312; 72/210; 72/60; 29/421.1; 29/243.58

(58) Field of Search ..... 72/57, 60, 58, 72/61, 210, 220, 312; 29/421.1, 243.58

(56) References Cited

U.S. PATENT DOCUMENTS 5,372,027 A * 12/1994 Roper et al. ..... 72/60
6,178,796 B1 * 1/2001 Hellgren ..... 72/55
6,253,588 B1 7/2001 Rashid et al. ..... 72/57
6,418,607 B1 * 7/2002 Seifert et al. ..... 29/421.1
6,425,277 B2 * 7/2002 Wiens ..... 29/243.58
6,581,428 B1 * 6/2003 Friedman ..... 72/57

FOREIGN PATENT DOCUMENTS

JP 61-262432 * 11/1986
JP 6-344037 * 12/1994
JP 7-60370 * 3/1996

* cited by examiner

*Primary Examiner*—David Jones
(74) *Attorney, Agent, or Firm*—Kathryn A. Marra

(57) ABSTRACT

A method is disclosed for forming a hem flange in an aluminum alloy sheet during the forming of the sheet into a panel that is intended to be attached to a second panel by hemming. The hem flange is formed by fluid pressure over a small radius tool portion to bend the flange from the sheet material and stretch the flange material below the bend to form a thinned hemline valley in the material. The original bend and thinned valley cooperate during the folding of the flange around the second panel to form a flat pinched hem without cracking or fracturing the flange material.

16 Claims, 2 Drawing Sheets

FLAT PINCH HEMMING OF ALUMINUM PANELS

TECHNICAL FIELD

This invention pertains to making flat hems or modified flat hems, sometimes called pinch hems, for aluminum panels. More specifically this invention pertains to a method of making flat, sharp pinch hems on aluminum automotive body panels that have been formed in a superplastic or other forming operation that involves stretching of an aluminum sheet.

BACKGROUND OF THE INVENTION

In a continuing effort to reduce weight in automotive vehicles, aluminum alloys are substituted for steels in many applications. Aluminum sheet alloys are not as easy to form or hem or weld, as are low carbon steel sheets. Considerable effort has been expended to develop aluminum alloys for sheet metal forming and welding. For example, U.S. Pat. No. 6,253,588, Rashid, et al, entitled "Quick Plastic Forming of Aluminum Alloy Sheet Metal" describes methods for stretch forming large sheets of superplastically formable (SPF) aluminum alloys into automotive body panels. Cold rolled Aluminum Alloy 5083 sheet that has been recrystallized to a very fine grain structure, sometimes called a pseudo-single phase material, is an example of a suitable SPF alloy.

Automobile body panels are usually of stylish threedimensional curvature and require a commercial quality outer surface for painting or other finishing. The methods of the '588 patent have been used by the assignee of this invention to make inner and outer deck lid panels and inner and outer lift gate panels. Other candidate vehicle closure panels include door and hood panels. Automobile closure panels have to be formed with commercially acceptable appearance and with suitable dimensional accuracy for fitting with adjacent body structures. Furthermore, flange portions of the outer panel must be capable of bending around the edges of an assembled inner panel in a hem that secures the panels in a rattle-free and attractive bond.

Commercial aluminum alloy sheet material (such as alloys of the 5xxx and 6xxx series) for body panel stamping processes are difficult to hem. Stamped sheets of these alloys often require a rope hem in which the flange of the outer panel is bent in a broad loop, as though folded around the circumference of a rope thicker than the inner sheet, to engage the inner panel. Such open hems have been necessary with aluminum sheet alloys if cracking or fracture of the hemmed material is to be avoided. Certain SPF aluminum panels stretch formed at about 400° C. to 500° C. as per the '588patent can be formed with a generally flat hem provided that the sheet metal is still soft after forming and the panel has been suitably formed with a thinned hemline. But there remains a need for the capability of forming a tighter pinch-type hem in SPF aluminum body panels and it is an object of this invention to provide such a method. Furthermore, there also remains a need for the capability of forming a flat hem in non-SPF aluminum body panels and it is a further object of this invention to provide such a method.

SUMMARY OF THE INVENTION

This invention provides a method for stretch forming aluminum alloy sheet stock into a body panel or the like, having a flange that can be bent around the edge of an assembled inner panel in a pinched hem. In a pinched hem the outer panel flange is bent with flat portions on each side of the edge of the inner panel and further creased in a fold outboard of the inner panel edge that is thinner than the three metal thickness stack-up of the hem near the inner panel at its edge. A hem that is pinched in this manner provides a tight grip on the inner panel. It is also a very attractive hem for automotive body panels. Such hems have not been attainable in aluminum vehicle panels without a special metal softening heat treatment subsequent to the stamping or stretch forming of the panel. The practice of the invention is particularly useful in the forming of superplastic formable aluminum alloy sheet material but it is not limited to the hemming of SPF aluminum alloys.

The practice of the invention can be illustrated using AA5083. This alloy has a typical composition, by weight, of 4% to 5% magnesium, 0.3 to 1% manganese, a maximum of 0.25% chromium, about 0.1% copper, up to about 0.3% iron, up to about 0.2% silicon, and the balance substantially all aluminum. Generally, a cast alloy ingot is first hot and then cold rolled to a thickness from about one to four millimeters. In SPF AA5083 alloys the microstructure is characterized by a principal phase of a solid solution of magnesium in aluminum with well distributed, finely dispersed particles of intermetallic compounds containing the minor alloying constituents, such as $Al_6Mn$. At the time of superplastic forming, the grain size is less than about ten to fifteen micrometers while the dispersed particle size is less than about two micrometers.

The magnesium containing aluminum alloy sheet stock is heated to a suitable temperature in the range of about 400° C. to 510° C. (750° F. to 950° F.) for stretch forming over a suitable tool defining the back of the panel to be formed. Gas pressure is applied to the front of the panel such as is described in the '588 patent.

In accordance with the invention, hemming flanges are formed at suitable edge locations as the sheet metal blank is progressively stretched into the shape of the panel over a period of a few minutes. The flange portions are progressively stretched and partially bent around a radius portion in the forming tool. The radius is suitably no more than about four times the thickness of the blank material so that sheet metal is selectively stretched and thinned into a hemline just past the bend line of the flange. Preferably the thinned hemline portion is reduced in thickness to about 50 to 90 percent of the thickness of the adjacent flange portion of the newly formed panel.

It is found that the bending of the flange and the formation of the thinned hemline under the pressure of a working fluid does not so work harden the flange that it cannot be subjected to a hemming operation. When the forming is done at an elevated temperature, such as a SPF temperature, the flange portion of the formed panel remains effectively annealed. After cooling and assembly with an inner panel, such thinned flange portions can be completely folded around the end or edge of the inner panel in a hem that is tighter than that of a flat hem. The hem flange can be creased at its edge so that the inside fold is thinner than the inner panel edge. As will be shown, the metal of the thinned flange can also be folded stepwise against the edge of the inner panel so that the hemmed metal lies flat close against the inner panel edge as well as flat against its sheet surfaces. Heretofore, such tight hems have been unattainable without cracking or breaking the folded aluminum sheet.

It is found that the invention is applicable generally to aluminum alloys, such as those of the AA5xxx and AA6xxx series, that are formed with a working fluid, such as a gas or water, with formed-in flanges. The formed flanges have a distinct thinning at the hemline. The forming process may be done at room temperature but more likely it will be done at an elevated temperature.

Other objects and advantages of the invention will become more apparent from a detailed description of a preferred embodiment, which follows.

DESCRIPTION OF THE PREFERRED EMBODIMENT

The practice of the invention will be illustrated in connection with stretch forming of a sheet of superplasticly formable (SPF) aluminum alloy 5083. A sheet of this magnesium containing aluminum alloy is heated to a temperature of about 400° C. to 510° C. The sheet metal is formed by stretch forming. A heated sheet blank is held between two opposing forming tool members that clamp the sheet at its edges. A working gas under suitable pressure (for example air, nitrogen or argon) is introduced against one side of the sheet to progressively force it into conformance with the forming surface of a forming tool. In stretch forming, the edges of the sheet are held fixed and sealed between the complimentary forming tool halves, and the interior of the heated sheet is literally stretched into conformance against the shaping surface of a tool by the gas pressure applied to the opposite side of the sheet. The stretch forming of a complex panel for an automotive vehicle in an SPF process may require a few minutes to several minutes. Of course, the stretching results in localized thinning of the original sheet as it is stretched.

In the case of forming an automobile body panel such as a hood, a door, or a deck lid, it is recognized that these body components typically comprise two sheets, that is, inner and outer panels. In order to attach the sheets into an assembled body closure panel it is a common practice to form a flange at one or more edges of the outer panel. After both panels have been separately formed, the inner panel is laid against the back surface of the outer panel and one or more flanges of the outer panel is folded around the edge of the inner panel in a hemming operation.

For years vehicle body panels have been made of low carbon steel and the hemming operation was readily accomplished because of the excellent malleability or formability of the steel sheet material. However, when aluminum alloy sheet materials are stamped, stretch formed or otherwise shaped into body panels, the hemming operation is more difficult because the aluminum is not as formable as low carbon steel. The hemming operation tends to produce cracks or fractures in the bend of the hemming flange. In accordance with the subject invention, the hem flange is formed and bent at an angle to the adjacent panel surface as the aluminum alloy body panel is being formed. The panel is formed from a sheet blank using a working fluid at a suitable pressure to shape the blank against a forming surface. Preferably the forming is done at an elevated temperature, e.g. below or at a superplastic forming temperature. And the flange is bent and formed with a suitable, thinned hemline as will be described.

Figure 1:
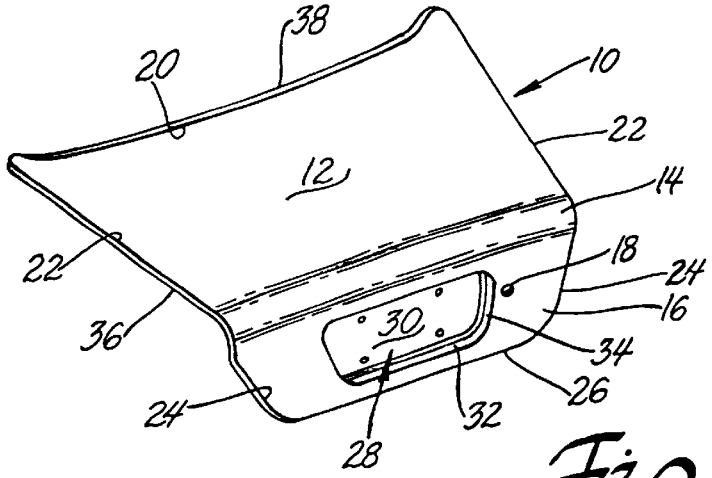
FIG. 1 shows an outer deck lid panel stretch formed by an SPF process with flanges for hemming to an inner panel.

The hem flange forming practice of the invention will be illustrated in connection with the forming of an entire automobile deck lid outer panel such as is depicted at 10 in FIG. 1. Deck lid 10 is a familiar shape with a curved generally horizontal deck portion 12 leading to bend 14 and to a curved generally vertical closure portion 16 that defines part of the rear of the car body. Of course, deck lid 10 is shaped to enclose the trunk compartment of the vehicle and, normally, to carry a latch and lock with pierced keyhole 18, and often a license plate in an integrally formed license plate recess 28.

Horizontal portion 12 has a forward edge 20 that is adapted to be fixed with a closure hinge to the car body usually below the rear window. Horizontal portion 12 also contains side edges 22 that fit close to the rear fender regions of the car body. Vertical portion 16 also has three edges. Side edges 24 fit close to the car body usually between the rear stoplights, and bottom edge 26 fits close to the body near the bumper level of the vehicle.

The deck lid 10 is of complex curvature, both across the width of the deck lid and across the length of its horizontal surface 12 and down its vertical surface 16. Deck lid 10 also includes the indented region 28 for holding a license plate. Indented or recessed region 28 has a bottom flat portion 30 with four very steep sidewalls. Two sidewalls 32, 34 are seen in the oblique view of FIG. 1.

In addition to the recessed portion 28, the deck lid outer panel is also formed with side flanges 36 (one shown in FIG. 1) at side edges 22 of the horizontal portion 12 and a panel break 38 at the forward edge 20 of horizontal portion 12. Bottom edge 26 also has a flange 40 shown, before trimming, in FIG. 2. The combination of the bend 14, the angles of formed flanges 36 and 40 and the steep walls 32 and 34 and flat bottom 30 of recess portion 28 of the deck lid require high local elongation of the sheet metal. They are difficult to form in a single work piece.

A deck lid outer panel was formed in accordance with this invention starting with a sheet metal blank of SPF aluminum alloy 5083. The blank size was 47" by 70" and 0.048" (1.2 millimeter) thick. The nominal composition of the aluminum alloy was, by weight, 4.5% magnesium, 0.7% manganese, 0.15% chromium, less than 0.2% iron, less than 0.1% silicon, and the balance substantially aluminum. An aqueous suspension of boron nitride lubricant particles was sprayed onto both sides of the aluminum blank surface. The coating was dried to produce a thin film of boron nitride forming lubricant.

Figure 2:
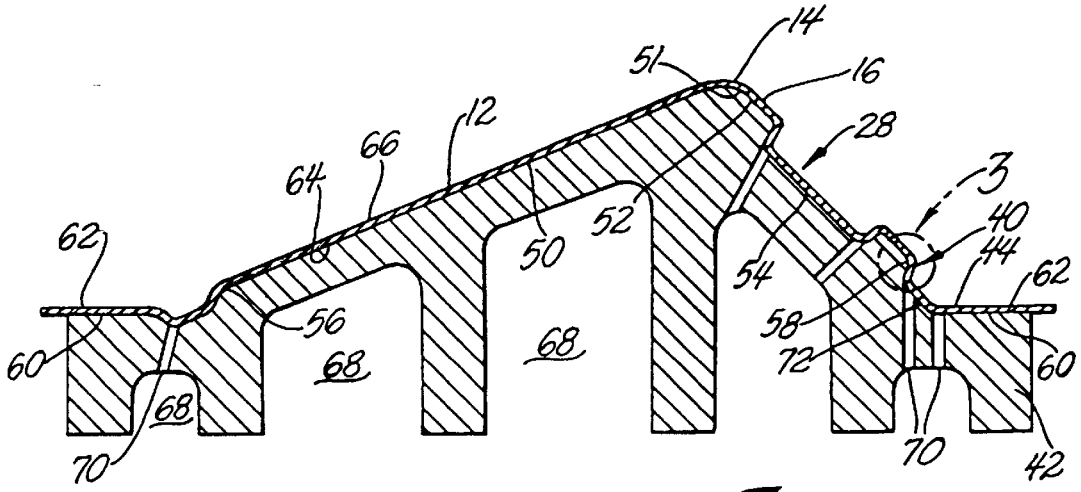
FIG. 2 is a cross-section of a stretch forming tool and a formed deck lid like that of FIG. 1, showing the formed hem flange.

The blank 44 (in FIG. 2) was heated to a forming temperature in the range of 825° F. to 845° F., about 441° C. to 452° C. The blank 44 was formed over a period of minutes into the configuration of a deck lid using two complimentary forming tools as illustrated in FIG. 2 of U.S. Pat. No. 6,253,588. The specification and drawings of the '588 patent are incorporated by reference herein for the description of a suitable panel forming process. The focus of this disclosure is on the shaping and initial bending of the hem flange and subsequent hemming operation, which is not a part of the "588" patent.

The lower forming tool 42 is shown in cross section in FIG. 2 of this specification. An upper forming tool as depicted in the '588 patent cooperates with the lower forming tool to secure peripheral edges 62 of the sheet metal blank 44 in FIG. 2. By securing edges 62, the hot blank is progressively stretched with its lower surface 64, the back surface of the deck lid, into conformance with the lower tool 42. The upper forming tool also provides a space for the working gas to press on the upper surface 66 of the blank, the front or visible surface of the deck lid, to push and stretch the blank into conformance with tool 42 as shown in FIG. 2.

FIG. 2 is a sectional view of the forming tool 42 and the blank 44 in its formed configuration, showing the various features of the forming tool for shaping the blank into deck lid 10. The FIG. 2 section is taken along the centerline of the car through the recessed license plate cavity 28 and the hemming flange 40 at the lower end 26 of deck lid panel 10.

Lower tool 42 contains a complex forming surface that defines the lower side 64 of blank 44 and the back side of one-piece outer deck lid panel 10. Lower tool 42 is seen to contain a forming surface portion 50 that defines the horizontal deck portion 12 of the deck lid and a large radius portion 51 that defines bend 14. Another portion 52 of tool 42 forms the vertical closure portion 16 of the deck lid 10. Still another shaping surface portion 54 of tool 42 defines the license plate recess 28. Other forming surface portions 56 and 58 form flanges 38, 40 at the forward edge 20 of horizontal portion 12 and the bottom edge 26 of vertical portion 16 of the deck lid, respectively. The periphery 60 of the rectangular lower shaping tool 42 has a flat surface for clamping (with an opposing tool) and sealing the edge portions 62 of the aluminum alloy blank 44.

As stated, the upper tool half (not shown in the drawings) is complimentary in shape to the male forming tool 42. It is provided with a shallow cavity for the introduction of a high pressure working gas, for example, air, nitrogen or argon against the upper side 66 of the blank 44. The periphery of the upper tool half is generally flat and adapted to sealingly engage and restrain movement of the perimeter 62 of the aluminum blank when the upper tool is closed against the blank 44 and lower tool 42.

The lower forming tool 42 is hollowed out in regions 68 to reduce mass and to facilitate machining of a plurality of vent holes 70. The vent holes 70 permit air or other entrapped gas to escape from below the blank 44 so that the blank can subsequently be gradually stretched into strict conformance with the shaping surfaces of forming tool 42.

A principal feature of the invention is the proper shaping of hem flanges on a panel such as outer deck lid panel 10. Flange 40 is a flange that is used for hemming engagement with a complementary inner deck lid panel. The bending and shaping of flange 40 during the shaping of the entire deck lid 10 is best illustrated with reference to FIGS. 2 and 3.

Figure 3:
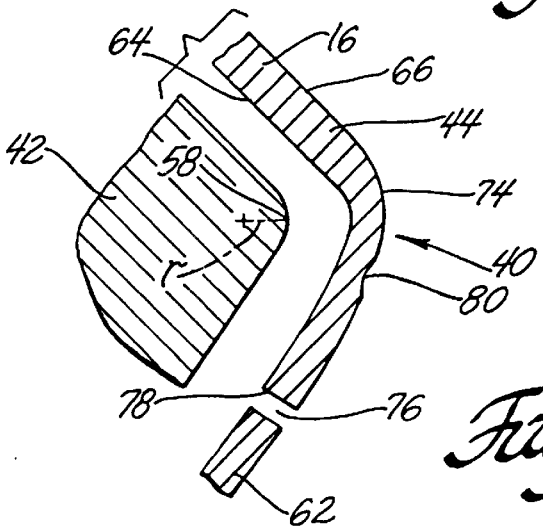
FIG. 3 is an enlarged and exploded view, taken at region 3 of FIG. 2, of a formed flange region with a thinned hemline.

FIG. 3 is an enlarged view of a portion of tool 42 (at radius portion 58) and the overlying portion of blank 44 at flange 40 taken at region 3 of FIG. 2. The portion of blank 44 shown in FIG. 3 includes a part of the vertical portion 16 of deck lid 10 below license plate recess 28. FIG. 3 also includes flange 40 that is a continuation of local vertical portion 16 and extends the length of deck lid bottom edge 26.

Flange 40 is formed by bending and stretching overlying sheet metal (of blank 44) around radius 58 of tool 42. Thus, in this portion of the newly formed deck lid seen in FIG. 3, vertical portion 16 terminates in a generally right angle bend at 74 around the radius corner 58 of tool 42 to form flange 40. The bending angle is set so as to both form a thinned hemline as described below and to permit removal of the finished panel from the tool. Later, upon removal of the formed deck lid 10 from tool 42, a cut is made as indicated at 76 in FIG. 3 to sever and trim away the peripheral portion 62 (as seen in FIG. 2) of blank 44, the remaining portion now deck lid 10. After this trim operation has been completed the vertical surface 16 of the deck lid terminates at the newly cut end 78 of flange 40.

During the forming of flange 40 sheet metal is stretched around radius 58 and pushed against the adjacent surface of tool 42 by the pressure of the working fluid. Again, the stretching occurs because the blank is secured at its edges 62 by the forming tools. It is found that if the radius 58 is small enough, the overlying blank material is held there, but the adjacent metal, just past bend 74, is stretched more severely. This results, surprisingly and beneficially, in a thinned hemline 80 in flange 40 extending the length of bend 74 and edge 26. The thinned valley that constitutes hemline 80 is apparently a result of the sheet metal being held at tool radius 58 causing greater stretching just downstream of it.

It is found that the creation of thinned hemline 80 results from controlling the size of radius 58. The size (r) of radius 58 of tool 42 is suitably less than four times the thickness of the original sheet size and preferably less than two times it thickness. Most preferably, radius 58 is not substantially larger than the specified thickness of blank 44 (in this example, 1.2 mm).

By forming the blank over the low radius corner 58, the flange portion 40 contains a thinned region 80 which is reduced in thickness to about 50 to 90% of the thickness of the blank at region 16. For example, in a formed deck lid panel 10; the thickness of the panel at vertical portion 16 near flange bend line 74 maybe 1.06 mm, the thickness just below bend 74 is about 0.95 mm, the thickness at hem line 80 is 0.79 mm, and the thickness just below 80 toward end 78 is 0.95 mm. It is this local thinning at hemline 80 which permits the formation of pinch hems that will be illustrated in FIGS. 4 and 5.

Figure 6:
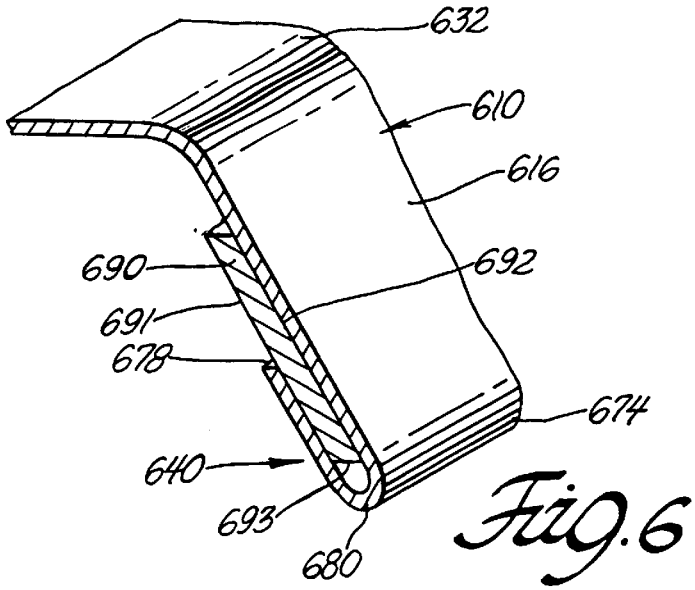
FIG. 6 is a fragmentary view, partly in section, of a flat hem between an outer panel like that of FIG. 1 and an inner panel.

In FIG. 6, a cross-section of the deck lid 610 is shown hemmed to an edge 693 of an inner deck lid panel 690. This sectional and fragmentary view of deck lid 610 contains a part of the license plate recess wall 632, as well as an illustrative part of vertical portion 616 of deck lid 610. Vertical portion 610 terminates in flange 640 at a U-shaped bend that includes original bend 674 and hemline 680. The remainder of flange 640 is seen pressed flat against a first flat surface 691 of inner panel 690. The end 678 of flange 640 lies close against flat surface 691 of inner panel 690 and vertical portion 616 of the outer panel 610 lies flat against a second flat surface 692 of inner panel 690.

Thus, the hemmed structure of outer panel 610 and inner panel 690 represents a substantially flat hem in which the hem comprises simply the thicknesses of two layers of the outer deck lid panel 610 and a single layer of the inner deck lid panel 690. The bend is a smooth U-shaped bend where the radius of the "U" is about half the thickness of inner panel 690. This result is obtained because of the crack and fracture free bend in flange 640 resulting from original bend 674 and thinned hemline 680. In elevated temperature forming of the sheet 44, the hemming step is also assisted because the flange material remains in the non-work-hardened condition. It has been found that this flat hem can be obtained following the stretch forming of superplastic formable aluminum alloy 5083 in making a deck lid like that of 10 in FIG. 1.

Figure 4:
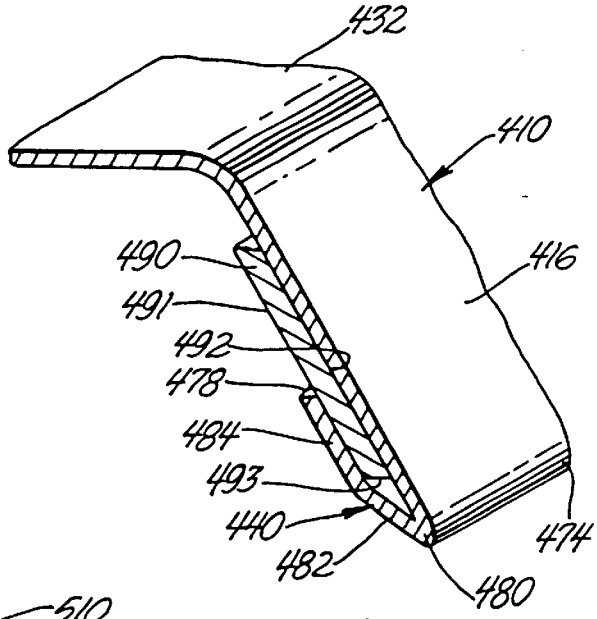
FIG. 4 is a fragmentary view, partly in section, of a first form of a pinch hem between an outer panel like that of FIG. 1 and an inner panel.
Figure 5:
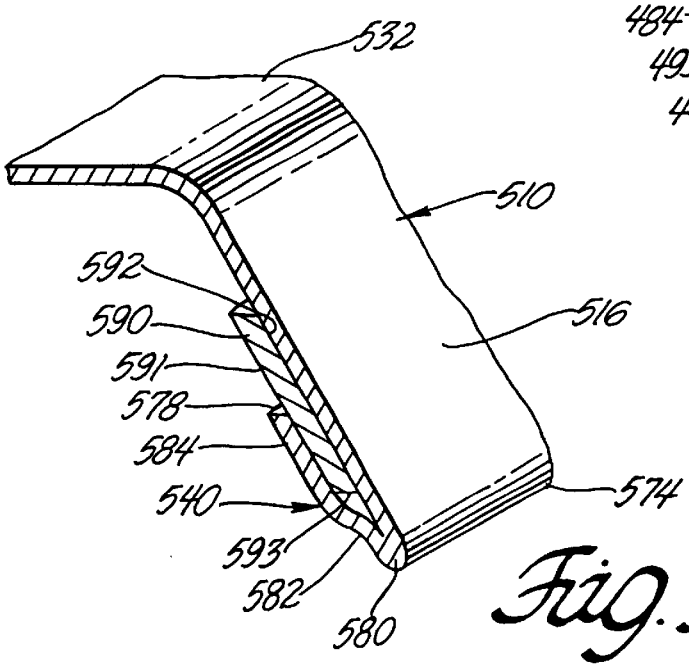
FIG. 5 is a fragmentary view, partly in section, of a second form of a pinch hem between an outer panel like that of FIG. 1 and an inner panel.

FIGS. 4 and 5 show hems that are more securely and tightly pinched than the flat hem structure illustrated in FIG. 6. For example, FIG. 4 shows a portion of a deck lid 410, like deck lid 10 in FIG. 1. Deck lid 410 comprises the license plate recess wall 432, vertical portion 416 of the deck lid, and a flange portion 440 pinched against flat surface 491 of inner panel 490. In FIG. 4, a thinned hemline 480 and original bend 474 cooperate to form a sharp creased fold around the end 493 of inner panel 490. The fold is V-shaped so that original flange 440 now has a first leg 482 that forms an acute angle with vertical portion 416 and a second leg 484 that bends from leg 482 and lies flat against surface 491 of inner panel 490. Vertical surface 416 lies flat against surface 492 of inner panel 490. This V-shaped fold is difficult to form in any metal panel. It is especially difficult to form in an aluminum sheet without cracking or fracturing the material. It was made possible here by the cooperation of the low radius bend 474 and thinned hemline 480.

In FIG. 5, the section fragment of deck lid 510 with its recess wall 532 and vertical portion 516 is even more sharply pinched around the end 593 of inner deck lid panel 590. Vertical portion 516 lies flat against inner panel surface 592. Vertical portion 516 ends in an attractive and tight hem resulting from original flange bend 574 and thinned hemline 580. Flange 540 now comprises a folded and curved leg 582 that lies close to vertical portion 516 and the end 593 of inner panel 590. Flange 540 also comprises portion 584, bent from portion 582, which lies flat and tight against surface 591 of inner panel 590 and flange end 578 lies against inner panel surface 591. This folding of material back onto itself is very difficult to form in an aluminum sheet without cracking or fracturing the material. It was made possible here by the cooperation of the low radius fold 574 and thinned hemline 580.

The flat hem of FIG. 6 and the pinch hems of FIGS. 4 and 5 are produced by known hem forming tooling practices. They may be produced using hammer and anvil tooling, or rolling tooling, or other suitable practices.

It is found that in order to achieve the pinch type flattened hems illustrated in FIGS. 4 and 5, it is necessary to produce a thinned down hem line, such as that illustrated at 80 in FIG. 3, 480 in FIG. 4, and 580 in FIG. 5. The thinned region is obtained during the high temperature stretch forming operation by forming a flange around a suitably small radius on the forming tool so that the metal drawn over the radius thins locally down- stream to produce a shallow, but distinct valley along the whole bend line of the flange. This hemline extends substantially across the whole length of the desired hem flange. While the invention has been described in connection with relatively high temperature, stretch forming operations on superplastic formable aluminum alloy 5083, the method can be practiced with non-superplastic formable, aluminum alloys. The sheet metal including the hem flanges is suitably formed under working fluid pressure around a suitably small radius like that depicted at 58 in FIG. 3. The working fluid may be a gas or liquid under suitably high forming pressure. Forming may done at room temperature but preferably is undertaken at higher temperatures.

While the invention has been described in terms of a few specific embodiments, it will be appreciated that other forms could readily be adapted by those skilled in the art. Accordingly, the scope of the invention is to be considered limited only by the following claims.

What is claimed is:

1. A method of forming an integral hem flange on an aluminum alloy sheet panel, said method comprising forming an aluminum alloy sheet into a panel of desired configuration with fluid pressure against a forming tool, said panel being intended for assembly with a separately formed second panel and attached to said second panel at least in part by said hem flange; and during said forming of said sheet panel, forming said hem flange by bending a portion of said sheet over a portion of said forming tool, said portion of said tool having a radius no larger than about four times the thickness of said sheet before forming, to form a bend the length of said hem flange, and stretching the portion of said sheet in the bent material adjacent to said bend to form a hemline along and adjacent to said bend, the thickness of said hemline being less than the thickness of adjacent sheet material in said flange.

2. A method as recited in claim 1 comprising, thereafter bending said hem flange portion at said hemline portion of said first panel around an edge of said second panel so that inside surfaces of the folded flange portion lie flat against the surfaces of said second panel at said edge and so that inside surfaces of said folded flange portion between said hemline and the edge of said second panel are more closely spaced than the thickness of said edge.

3. A method as recited in claim 1 in which said radius is no larger than two times the thickness of said sheet.

4. A method as recited in claim 2 in which said radius is no larger than two times the thickness of said sheet.

5. A method as recited in claim 1 in which said hemline portion is reduced to a thickness of about fifty to ninety percent of the thickness of the adjacent flange portion.

6. A method as recited in claim 2 in which said hemline portion is reduced to a thickness of about fifty to ninety percent of the thickness of the adjacent flange portion.

7. A method as recited in claim 1 comprising forming said sheet with liquid pressure at ambient temperature.

8. A method as recited in claim 2 comprising forming said sheet with liquid pressure at ambient temperature.

9. A method as recited in claim 1 comprising forming said sheet with liquid pressure or the pressure of a working gas at an elevated forming temperature for said alloy.

10. A method as recited in claim 2 comprising forming said sheet with liquid pressure or the pressure of a working gas at an elevated forming temperature for said alloy.

11. A method as recited in claim 1 in which said sheet is a superplasticly formable aluminum alloy and said sheet is formed at a superplastic forming temperature for said alloy with a gas under pressure.

12. A method as recited in claim 2 in which said sheet is a superplasticly formable aluminum alloy and said sheet is formed at a superplastic forming temperature for said alloy with a gas under pressure.

13. A method of forming a hem between a hem flange portion of an aluminum alloy sheet first panel and an edge of a second sheet panel, said method comprising heating a superplasticly formable, aluminum alloy sheet to a forming temperature;

forming the sheet into said first panel with fluid pressure against a forming tool, said panel being intended for assembly with a separately formed second panel and attached to said second panel at least in part by a hem flange on said first panel, and during the forming of said first panel sheet forming said hem flange by bending a portion of said sheet over a portion of said forming tool, said portion of said tool having a radius no larger than about four times the thickness of said sheet before forming, to form a bend line the length of said hem flange, and stretching the portion of said sheet in the bent material adjacent to said bend line to form a hemline along and adjacent to said bend line, the thickness of said hemline being less than the thickness of adjacent sheet material in said hem flange;

cooling said first panel to ambient temperature; and bending said hem flange portion at said hem line portion of said first panel around said edge of said second panel so that inside surfaces of the folded flange portion lie flat against the surfaces of said second panel at said edge and so that inside surfaces of said folded flange portion between said hemline and the edge of said second panel are more closely spaced than the thickness of said edge.

14. A method as recited in claim 13 in which said radius is no larger than two times the thickness of said sheet.

15. A method as recited in claim 13 in which said hemline portion is reduced to a thickness of about fifty to ninety percent of the thickness of the adjacent flange portion.

16. A method as recited in claim 14 in which said hemline portion is reduced to a thickness of about fifty to ninety percent of the thickness of the adjacent flange portion.

* * * * *